US007319432B2

(12) United States Patent
Andersson

(10) Patent No.: US 7,319,432 B2
(45) Date of Patent: Jan. 15, 2008

(54) MULTIBAND PLANAR BUILT-IN RADIO ANTENNA WITH INVERTED-L MAIN AND PARASITIC RADIATORS

(75) Inventor: Johan Andersson, Malmo (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 10/507,574

(22) PCT Filed: Mar. 11, 2003

(86) PCT No.: PCT/EP03/02473

§ 371 (c)(1),
(2), (4) Date: Dec. 2, 2004

(87) PCT Pub. No.: WO03/077360

PCT Pub. Date: Sep. 18, 2003

(65) Prior Publication Data

US 2005/0110692 A1 May 26, 2005

Related U.S. Application Data

(60) Provisional application No. 60/366,514, filed on Mar. 19, 2002.

(30) Foreign Application Priority Data

Mar. 14, 2002 (EP) ..... 02005816

(51) Int. Cl.
*H01Q 1/24* (2006.01)

(52) U.S. Cl. ..... 343/702

(58) Field of Classification Search ..... 343/702, 343/846, 815, 817, 700 MS
See application file for complete search history.

(56) References Cited

U.S. PATENT DOCUMENTS 5,583,521 A 12/1996 Williams
6,326,921 B1 12/2001 Egorov et al.
6,348,897 B1 * 2/2002 Alameh et al. ..... 343/702

(Continued)

FOREIGN PATENT DOCUMENTS

EP 0757405 2/1997
JP 06-037531 2/1994

OTHER PUBLICATIONS

P. Song et al., "Triple-Band Planar Inverted F Antenna", IEEE, 1999, pp. 908-911.

(Continued)

*Primary Examiner*—Shih-Chao Chen
*Assistant Examiner*—Minh Dieu A
(74) *Attorney, Agent, or Firm*—Renner, Otto, Boisselle & Sklar, LLP

(57) ABSTRACT

A multi-band radio antenna device (1) for a radio communication terminal, comprising a flat ground substrate (20), a flat main radiating element (2, 9) having a radio signal feeding point (3), and a flat parasitic element (5, 6). The main radiating 5 element is located adjacent to and in the same plane as said ground substrate, and preferably dielectrically separated therefrom. The antenna device is suitable for being used as a built-in antenna in portable radio terminals, such as a mobile phone (30).

33 Claims, 6 Drawing Sheets

U.S. PATENT DOCUMENTS 6,408,190 B1 * 6/2002 Ying ..... 455/553.1
6,414,637 B2 * 7/2002 Keilen ..... 343/700 MS
6,466,170 B2 * 10/2002 Zhou ..... 343/700 MS
6,650,294 B2 * 11/2003 Ying et al. ..... 343/700 MS
6,674,409 B2 * 1/2004 Cheah ..... 343/795
2001/0050636 A1 12/2001 Weinberger

OTHER PUBLICATIONS

C.T.P. Song et al., "Triple Band Planar Inverted F Antennas for Handheld Devices", Electronic Letters, Jan. 20, 2000, vol. 36, No. 2.

* cited by examiner

MULTIBAND PLANAR BUILT-IN RADIO ANTENNA WITH INVERTED-L MAIN AND PARASITIC RADIATORS

This patent application claims the benefit of priority from U.S. Provisional Application Ser. No. 60/366,514 filed on Mar. 19, 2002. This application incorporates by reference the entire disclosure of U.S. Provisional Patent Application Ser. No. 60/366,514.

FIELD OF THE INVENTION

The present invention relates generally to antennas for radio communication terminals and, in particular, to compact built-in antennas devised to be incorporated into portable terminals and having a wide bandwidth to facilitate operation of the portable terminals within different frequency bands.

BACKGROUND

Since the end of the $2000^{th}$ century the cellular telephone industry has had enormous development in the world. From the initial analog systems, such as those defined by the standards AMPS (Advanced Mobile Phone System) and NMT (Nordic Mobile Telephone), the development has during recent years been almost exclusively focused on standards for digital solutions for cellular radio network systems, such as D-AMPS (e.g., as specified in EIA/TIA-IS-54-B and IS-136) and GSM (Global System for Mobile Communications). Different digital transmission schemes are used in different systems, e.g. time division multiple access (TDMA) or code division multiple access (CDMA). Currently, the cellular technology is entering the so called $3^{rd}$ generation, providing several advantages over the former, $2^{nd}$ generation, digital systems referred to above. Among those advantages an increased bandwidth will be provided, allowing effective communication of more complex data. The $3^{rd}$ generation of mobile systems have been referred to as the UMTS (Universal Mobile Telephony System) in Europe and CDMA2000 in the USA, and is already implemented in Japan to some extent. Furthermore, it is widely believed that the first generation of Personal Communication Networks (PCNs), employing low cost, pocket-sized, cordless telephones that can be carried comfortably and used to make or receive calls in the home, office, street, car, etc., will be provided by, for example, cellular carriers using the next generation digital cellular system infrastructure.

One evolution in cellular communication services involves the adoption of additional frequency bands for use in handling mobile communications, e.g., for Personal Communication Services (PCS) services. Taking the U.S. as an example, the Cellular hyperband is assigned two frequency bands (commonly referred to as the A frequency band and the B frequency band) for carrying and controlling communications in the 800 MHz region. The PCS hyperband, on the other hand, is specified in the United States to include six different frequency bands (A, B, C, D, E and F) in the 1900 MHz region. Thus, eight frequency bands are now available in any given service area of the U.S. to facilitate communication services. Certain standards have been approved for the PCS hyperband (e.g., PCS1900 (J-STD-007)), while others have been approved for the Cellular hyperband (e.g., D-AMPS (IS-136)). Other frequency bands in which these devices will be operating include GPS (operating in the 1.5 GHz range) and UMTS (operating in the 2.0 GHz range).

Each one of the frequency bands specified for the Cellular and PCS hyperbands is allocated a plurality of traffic channels and at least one access or control channel. The control channel is used to control or supervise the operation of mobile stations by means of information transmitted to and received from the mobile stations. Such information may include incoming call signals, outgoing call signals, page signals, page response signals, location registration signals, voice channel assignments, maintenance instructions, handoff, and cell selection or reselection instructions as a mobile station travels out of the radio coverage of one cell and into the radio coverage of another cell. The control and voice channels may operate using either analog modulation or digital modulation.

The signals transmitted by a base station in the downlink over the traffic and control channels are received by mobile or portable terminals, each of which have at least one antenna. Historically, portable terminals have employed a number of different types of antennas to receive and transmit signals over the air interface. For example, monopole antennas mounted perpendicularly to a conducting surface have been found to provide good radiation characteristics, desirable drive point impedances and relatively simple construction. Monopole antennas can be created in various physical forms. For example, rod or whip antennas have frequently been used in conjunction with portable terminals. For high frequency applications where an antenna's length is to be minimized, another choice is the helical antenna. In addition, mobile terminal manufacturers encounter a constant demand for smaller and smaller terminals. This demand for miniaturization is combined with desire for additional functionality such as having the ability to use the terminal at different frequency bands and different cellular systems.

It is commercially desirable to offer portable terminals which are capable of operating in widely different frequency bands, e.g., bands located in the 1500 MHz, 1800 MHz, 1900 MHz, 2.0 GHz and 2.45 GHz regions. Accordingly, antennas which provide adequate gain and bandwidth in a plurality of these frequency bands will need to be employed in portable terminals. Several attempts have been made to create such antennas.

Japanese patent no. 6-37531 discloses a helix which contains an inner parasitic metal rod. In this patent, the antenna can be tuned to dual resonant frequencies by adjusting the position of the metal rod. Unfortunately, the bandwidth for this design is too narrow for use in cellular communications.

Dual-band, printed, monopole antennas are known in which dual resonance is achieved by the addition of a parasitic strip in close proximity to a printed monopole antenna. While such an antenna has enough bandwidth for cellular communications, it requires the addition of a parasitic strip. Motel AB in Sweden has designed a coil matching dual-band whip antenna and coil antenna, in which dual resonance is achieved by adjusting the coil matching component (¼.lambda. For 900 MHz and ½.lambda. For 1800 MHz). This antenna has relatively good bandwidth and radiation performances and a length in the order of 40 mm.

In order to reduce the size of the portable radio terminals, built-in antennas have been implemented over the last couple of years. The general desire today is to have an antenna, which is not visible to the customer. Today different kinds of patches are used, with or without parasitic elements. The most common built-in antennas currently in use in mobile phones are the so called planar inverted-F antennas (PIFA). This name has been adopted due to the fact that the antenna looks like the letter F tilted 90 degrees in profile.

Such an antenna needs a feeding point as well as a ground connection. If one or several parasitic elements are included nearby, they can be either grounded or dielectrically separated from ground.

The PIFA can, as mentioned, be built in into a radio terminal antenna, e.g. a mobile phone, with fairly low profile. However, as mobile phones become smaller and smaller, the height of the PIFA antennas are still a limiting factor for decreasing the terminal size. The geometry of a conventional PIFA antenna includes a radiating element, a feeding pin for the radiating element, a ground pin for the radiating element, and a ground substrate commonly arranged on a printed circuit board (PCB). Both the feeding pin and the ground pin are arranged perpendicular to the ground plane, and radiating element is suspended above the ground plane in such a manner that the ground plane covers the area under the radiating element. This type of antenna, however, generally has a fairly small bandwidth in the order of 100 MHz. In order to increase the bandwidth for an antenna of this design, the vertical distance between the radiating element and the PCB ground has to be increased, i.e. the height at which the radiating element is placed above the PCB is increased. This, however, is an undesirable modification as the height increase makes the antenna unattractive for small communication devices. One solution to this problem is to add a dielectric element between the antenna and the PCB, in order to make the electrical distance longer than the physical distance.

U.S. Pat. No. 6,326,921 to Yang et al discloses a built-in, low-profile antenna with an inverted planar inverted F-type (PIFA) antenna and a meandering parasitic element, and having a wide bandwidth to facilitate communications within a plurality of frequency bands. A main element is placed at a predetermined height above a substrate of a communication device and the parasitic element is placed on the same substrate as the main antenna element and is grounded at one end. The feeding pin of the PIFA is proximate to the ground pin of the parasitic element. The coupling of the meandering, parasitic element to the main antenna results in two resonances. These two resonances are adjusted to be adjacent to each other in order to realize a broader resonance encompassing the DCSS (Digital Cross-Connect System), PCS (Personal Communications System) and UMTS frequency ranges.

However, prior art antenna designs will still be a limiting factor when developing radio terminals with adequate bandwidth to cover, for example, all of the DCSS, PCS and UMTS frequency bands, at the same time recognizing the desire to provide compact terminals. The known solutions have mainly dual band performance, e.g. GSM+DCSS. They need a ground plane underneath the antenna structure. The larger distance the better antenna performance, to a certain degree, and since the mobile phones of today must be as small and thin as possible, this is a dilemma. A more general problem with built-in antennas is not only small band width, but also significantly worse gain performance than a traditional external antenna i.e. Some kind of stub antenna.

SUMMARY OF THE INVENTION

Hence, it is an object of the present invention to overcome the above-identified deficiencies related to the prior art, and more specifically to provide a planar antenna structure suitable for built-in antennas, at the same time having a wide bandwidth which enables the antenna to be operable at a plurality of frequency bands.

According to a first aspect, this object is fulfilled by a multi-band radio antenna device for a radio communication terminal, comprising a flat ground substrate, a flat main radiating element having a radio signal feeding point, and a flat parasitic element. Said main radiating element is located in the same plane as said ground substrate, wherein a first elongated portion of the main radiating element extends in an L shape away from a side edge of the ground substrate, the longer leg of said L shape extending substantially parallel to said side edge.

Preferably, said first elongated portion has a first width and extends into a second elongated portion having a second width, smaller than said first width. The length of said first portion preferably corresponds to the resonance of a first radio wavelength zone and the combined length of said first and second portion corresponds to the resonance of a second radio wavelength zone, by interaction with the parasitic element.

Preferably, said flat parasitic element comprises a first L-shaped parasitic member extending from an electrical connection point to said ground substrate essentially parallel to said first portion of the main antenna element. In one embodiment, said flat parasitic element further comprises a second L-shaped parasitic member extending from an electrical connection point to said ground substrate, essentially parallel to said first parasitic member. The main radiating element is preferably dielectrically separated from the ground substrate.

In a preferred embodiment, said second portion of the main element is meandered, and preferably, said first width is at least 5 times larger than said second width. In one embodiment, said first width is at least 10 times larger than said second width.

According to a second aspect, the object of the invention is fulfilled by a communication terminal devised for multi-band radio communication, comprising a housing, a user input and output interface, and in said housing a built-in antenna device including a flat ground substrate, a flat main radiating element having a radio signal feeding point, and a flat parasitic element. Said main radiating element is located in the same plane as said ground substrate, wherein a first elongated portion of the main radiating element extends in an L shape away from a side edge of the ground substrate, the longer leg of said L shape extending substantially parallel to said side edge.

Preferably, said first elongated portion has a first width and extends into a second elongated portion having a second width, smaller than said first width. The length of said first portion preferably corresponds to the resonance of a first radio wavelength and the combined length of said first and second portion corresponds to the resonance of a second radio wavelength.

Preferably, said flat parasitic element comprises a first L-shaped parasitic member extending from an electrical connection point to said ground substrate essentially parallel to said first portion of the main antenna element. In one embodiment, said flat parasitic element further comprises a second L-shaped parasitic member extending from an electrical connection point to said ground substrate, essentially parallel to said first parasitic member. The main radiating element is preferably dielectrically separated from the ground substrate.

In a preferred embodiment, said second portion of the main element is meandered, and preferably, said first width is at least 5 times larger than said second width. In one embodiment, said first width is at least 10 times larger than said second width.

According to a third aspect, the object of the invention is fulfilled by a multi-band radio antenna for a radio communication terminal, comprising a flat main radiating element having a radio signal feeding point, and a flat parasitic element, wherein said antenna is connectable to a flat ground substrate by interconnection with said parasitic element. Said main radiating element is located in the same plane as said ground substrate, wherein a first elongated portion of the main radiating element extends in an L shape away from a side edge of the ground substrate, the longer leg of said L shape extending substantially parallel to said side edge.

According to a fourth aspect, the object of the invention is fulfilled by an integrated multi-band radio antenna and ground substrate device for a radio communication terminal, comprising a flat ground substrate, a flat main radiating element having a radio signal feeding point, and a flat parasitic element. Said main radiating element is located in substantially the same plane as said ground substrate, wherein a first elongated portion of the main radiating element extends in an L shape away from a side edge of the ground substrate, the longer leg of said L shape extending substantially parallel to said side edge.

Preferably, said ground substrate, said main radiating element and said parasitic element are formed of a single sheet of electrically conductive material, and in one embodiment they are etched out from a metal layer on a printed circuit board. In one embodiment, the features of which are equally applicable to any of the previously mentioned aspects, said ground substrate is formed on one layer of a printed circuit board, whereas said main radiating element and said parasitic element are formed on another layer on said printed circuit board. The ground substrate and the antenna will nevertheless be substantially located in the same plane, particularly compared to the conventional PIFA design.

By substantially parallel is here meant that the distance between longer leg of the radiating element and the edge of the ground substrate is essentially constant over the extension of said longer leg, within the accuracy given by the used method of manufacture.

BRIEF DESCRIPTION OF THE DRAWINGS

The features and advantages of the present invention will be more apparent from the following description of the preferred embodiments with reference to the accompanying drawings, on which FIG. 1 schematically illustrates a multi-band radio antenna device according to an embodiment of the invention.

DETAILED DESCRIPTION OF PREFERRED EMBODIMENTS

Figure 1:
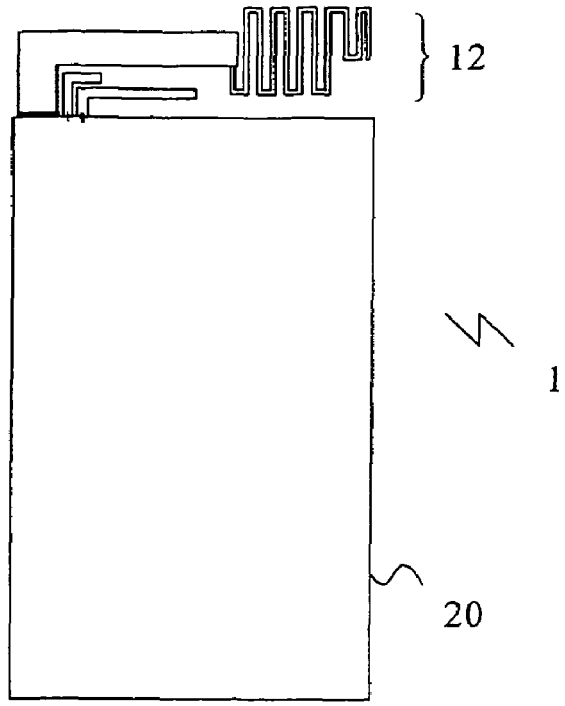

The present description refers to radio terminals as a device in which to implement a radio antenna design according to the present invention. The term radio terminal includes all mobile equipment devised for radio communication with a radio station, which radio station also may be mobile terminal or e.g. a stationary base station. Consequently, the term radio terminal includes mobile telephones, pagers, communicators, electronic organizers, smartphones, PDA:s (Personal Digital Assistants), vehicle-mounted radio communication devices, or the like, as well as portable laptop computers devised for wireless communication in e.g. a WLAN (Wireless Local Area Network). Furthermore, since the antenna as such is suitable for but not restricted to mobile use, the term radio terminal should also be understood as to include any stationary device arranged for radio communication, such as e.g. desktop computers, printers, fax machines and so on, devised to operate with radio communication with each other or some other radio station. Hence, although the structure and characteristics of the antenna design according to the invention is mainly described herein, by way of example, in the implementation in a mobile phone, this is not to be interpreted as excluding the implementation of the inventive antenna design in other types of radio terminals, such as those listed above. Furthermore, it should be emphasized that the term comprising or comprises, when used in this description and in the appended claims to indicate included features, elements or steps, is in no way to be interpreted as excluding the presence of other features elements or steps than those expressly stated.

Several of the larger mobile phone manufacturers, e.g. Ericsson® and Nokia®, have launched mobile phones for cellular communication networks and implementing built-in antennas for both dual band and triple band operation. By built-in is here meant that the antenna is placed inside, or adjacent to, the housing or chassis of the mobile phone without protruding elements. The principles of the Planar Inverted F Antenna type have been briefly discussed above. Although it may be embodied in different ways, it is basically defined by the following features:

- Dual or triple band capacity;
- Patch parallel to the printed circuit board (PCB), i.e. the ground plane;
- Air or some dielectric material between antenna and PCB;
- Sizes are in the neighborhood of L*W*H=40*18*8 mm;
- The distance (H) between antenna and PCB is critical for good VSWR and gain, and normal distance is 7-10 mm between these two planes;
- The antenna needs both feeding and grounding.

The present invention provides an antenna design which does not need a ground plane underneath the antenna structure. This makes it possible to make a very thin product. Computer simulations with surprisingly good results have been made. These simulations have been performed using the tool IE3D, distributed by Zeland Inc. This tool uses the Moment Method as a mathematical solver, and simulation results obtained correlate well with measurement tests on prototypes disclosed in FIGS. 6A and 6B, which will be explained further down.

An antenna concept or design is described herein, comprising the antenna structure, its relation to ground, and its implementation in a radio terminal, with reference to the accompanying drawings. Some features of one embodiment of the antenna design are a very wide feeding and two parasitic elements without feeding. FIG. 1 discloses an antenna device 1, comprising an antenna 12 and a ground plane or substrate 20. The length of the ground plane 20, i.e. the height in FIG. 1, is preferably approximately equal to one third of the wavelength for the lower radio frequency band for which the multi-band antenna 12 is tuned. The ground plane length can be calculated as:

$$L=c/3f,$$

wherein L is the ground plane length, c is the speed of light in vacuum and f is the radio frequency. In one example said lower band is f=900 MHz, wherein the ground plane length can be calculated to approximately 11 cm.

Figure 2:
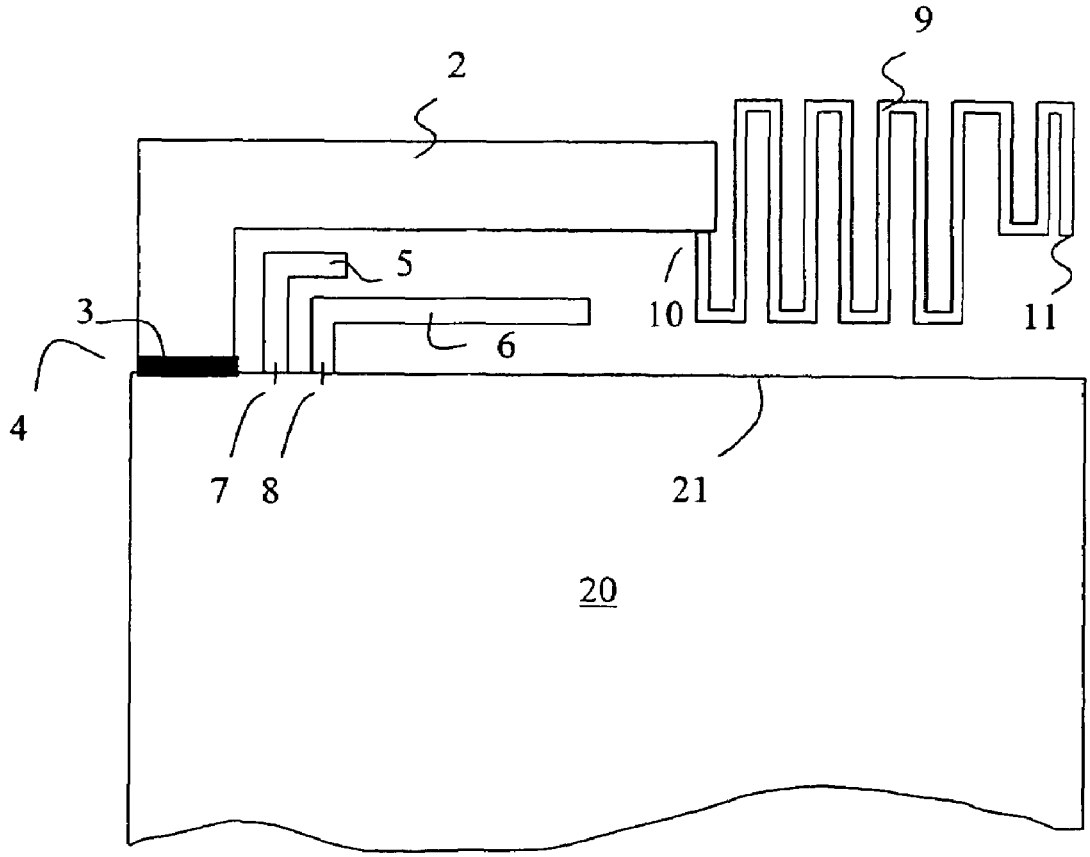
FIG. 2 shows an enlarged portion of the antenna device according to FIG. 1.

FIG. 2 illustrates the upper part of FIG. 1 in enlargement, with only a part of the ground plane 20 showing. The antenna in FIG. 2 comprises several parts, and discloses an embodiment according to the example above, i.e. tuned for a lower frequency band of 900 MHz.

The main radiating element of the antenna comprises a first flat elongated member 2, which extends from a position 4 close to the upper edge 21 of ground plane 20. In the preferred and disclosed embodiment, this elongated member is bent 90 degrees in order to make the total length of the antenna device 1, including the ground plane 20, as short as possible. The main radiating element is fed at a feeding point 3 at or near its base 4, adjacent to the edge 21 of the ground plane 20, but it is dielectrically separated from the ground plane 20, e.g. by a gap.

The elongated member 2 has a large width, in the disclosed embodiment about 5.4 mm. This large width contributes to the large bandwidth shown in FIGS. 6A and 6B. The total length of the wide elongated member 2 is about 35 mm from 4 to 10. At this end 10, the main radiating element extends into a considerably longer, meandered member 9, which has a significantly smaller width than member 2. The barrier obtained by the bottleneck at 10 creates one resonance dependent on the length of the wide member 2, and another resonance dependent on the entire length of the main radiating element 2,9 from end 4 at the feeding point 3 to the end point 11. The relation between the width of member 2 and member 9 is at least 5:1, and preferably about 10:1. This relation is hence important in order to get the multi-band performance. At the end 11 of the meandered portion 9, yet another radiating element may be added, electrically interconnected to portion 9, although not shown, a so called capacitive end piece.

A thin parasitic element member 5 is connected to the ground plane 20 at 7, and runs parallel with the main antenna member 2. The width of this first parasitic element member 5 is approximately 1 mm, and it is positioned close to, about 1 mm, the electrically fed antenna element 2,9. The total length of the first parasitic member 5 is approximately 21.1 mm in the disclosed embodiment.

Another thin parasitic element 6, likewise connected to the ground plane at 8, extends parallel with parasitic member 5. The approximate length of this second parasitic member 6 is 21 mm in the disclosed embodiment. The width of member 6 and the distance between member 6 and 5 is of the same order as the width of member 5 and the distance between member 5 element 2, respectively.

Figure 3:
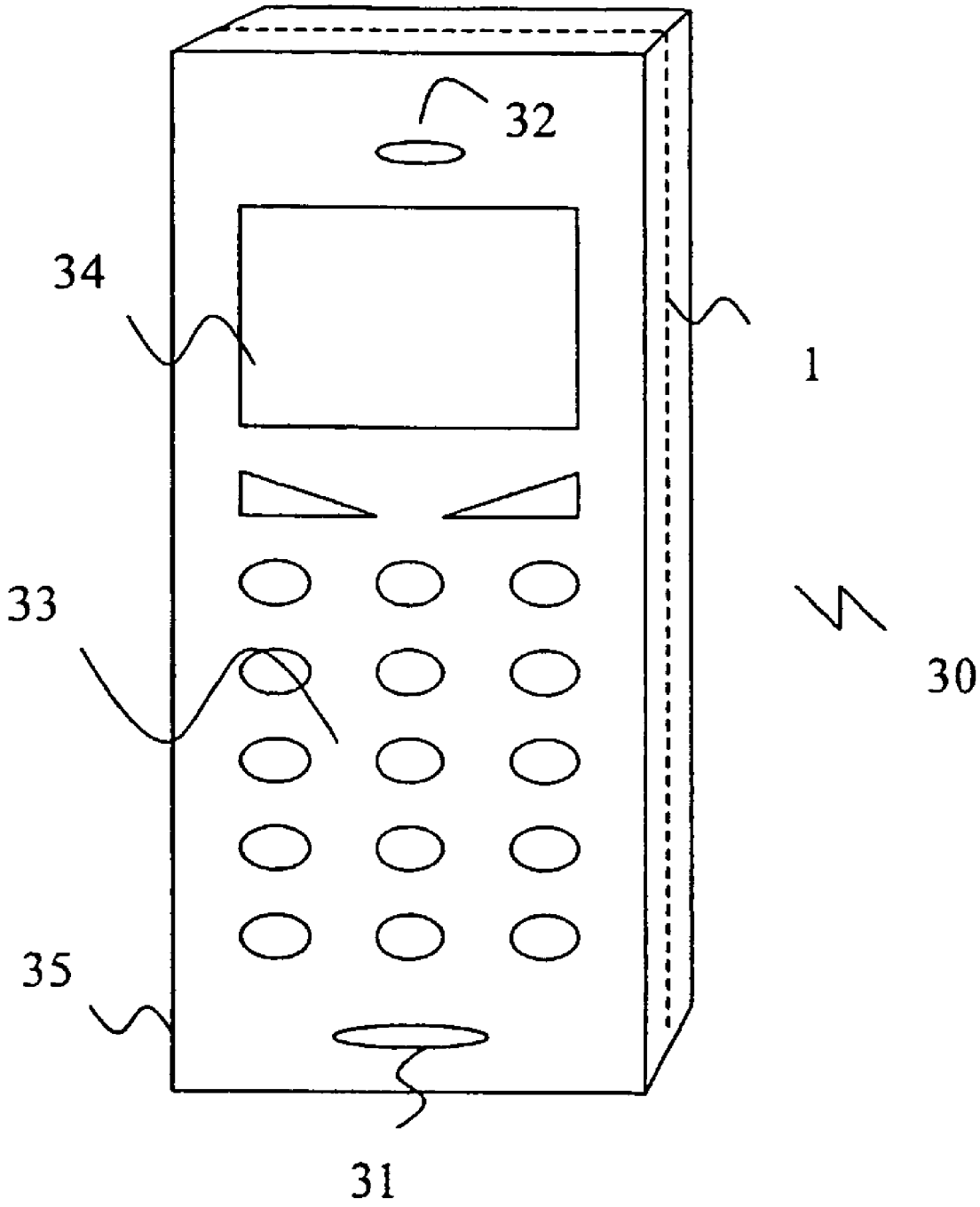
FIG. 3 schematically illustrates an exemplary communication terminal implementing an antenna design according to an embodiment of the invention.

FIG. 3 illustrates a communication radio terminal in the embodiment of a cellular mobile phone 30 devised for multi-band radio communication. The terminal 30 comprises a chassis or housing 35, carrying a user audio input in the form of a microphone 31 and a user audio output in the form of a loudspeaker 32 or a connector to an ear piece (not shown). A set of keys, buttons or the like constitutes a data input interface 33 is usable e.g. for dialing, according to the established art. A data output interface comprising a display 34 is further included, devised to display communication information, address list etc in a manner well known to the skilled person. The radio communication terminal 30 includes radio transmission and reception electronics (not shown), and is devised with a built-in antenna device 1 inside the housing 35, which antenna device is indicated in the drawing by the dashed line as an essentially flat object. According to the invention, this antenna device 1, corresponding to FIG. 1, includes a flat ground substrate 20, a flat main radiating element 2,9 having a radio signal feeding point 3, and a flat parasitic element 5,6. The main radiating element 2,9 is dielectrically separated from the ground substrate, and located adjacent to and in the same plane as said ground substrate. The other features of the antenna design according to the present invention described above are naturally equally valid for the radio terminal implemented embodiment of FIG. 3.

Figure 4:
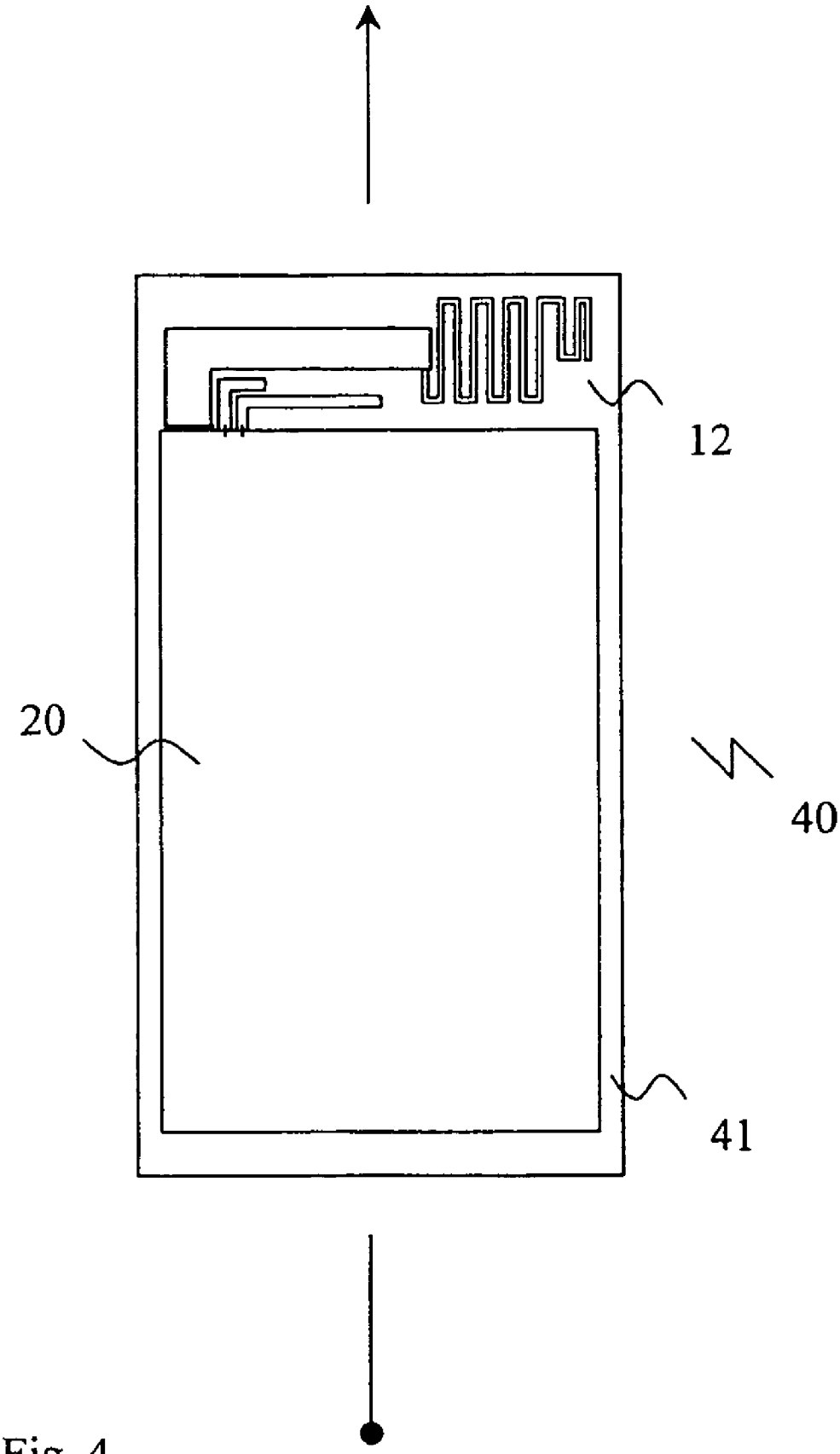
FIG. 4 schematically illustrates an integrated multi-band radio antenna and ground substrate device according to an embodiment of the invention.

FIG. 4 illustrates another aspect of the present invention. As described previously, with reference mainly to FIGS. 1 and 2, the antenna 12 and ground plane 20 of the antenna device 1 are located adjacent to each other in the same plane. Not all parts of the antenna device are electrically interconnected, e.g. not the main radiating element 2,9 and the ground plane 20, but they may nevertheless be formed as a single integrated element. Alternatively, the ground substrate 20 and the antenna element 2,9 may be located on different layers of a printed circuit board, which board defines the plane in which they are arranged. Hence, according to this aspect FIG. 4 illustrates an integrated multi-band radio antenna and ground substrate device 40 for a radio communication terminal. This integrated device 40 comprises a flat ground substrate 20, a flat main radiating element 2,9 having a radio signal feeding point 3, and a flat parasitic element 5,6, wherein said main radiating element is dielectrically separated from the ground substrate, and located adjacent to and in the same plane as said ground substrate. The elements 2,9,5,6,20 comprised in the integrated device 40 are bonded by an underlying dielectric substrate 41, such as a PCB, wherein said PCB 41 preferably carries radio terminal electronics on its opposite side and optionally on intermediate layers thereof. According to this aspect of the invention, the ground substrate 20, the main radiating element 2,9 and the parasitic element 5,6 are, in one embodiment, formed of a single sheet of electrically conductive material. In such a design, the interconnections 7 an 8 between the parasitic members 5,6 and the ground plane 20 are preferably simply formed by said parasitic members extending into the ground plane 20, being an integral part thereof. Furthermore, the feeding point 3 (see FIG. 2) may be a direct contact between the main radiating element 2 and the relevant leads on the PCB 41, wherein no auxiliary antenna connector is needed. In one embodiment, the integrated multi-band radio antenna 12 and ground substrate 20 is etched out from a metal layer on a printed circuit board 41, including the ground substrate, the main radiating element and the parasitic element.

Figure 5A:
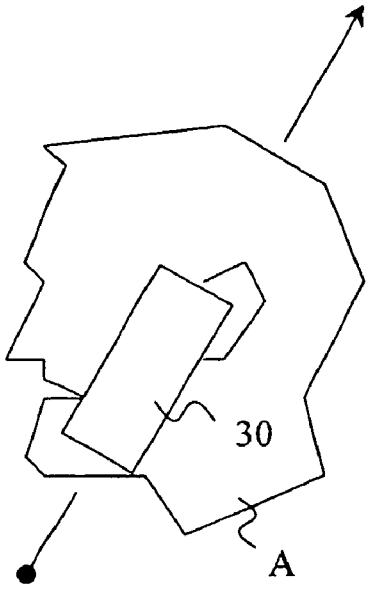
FIGS. 5A to 5C schematically illustrates the use of a communication terminal according to FIG. 3.
Figure 5B:
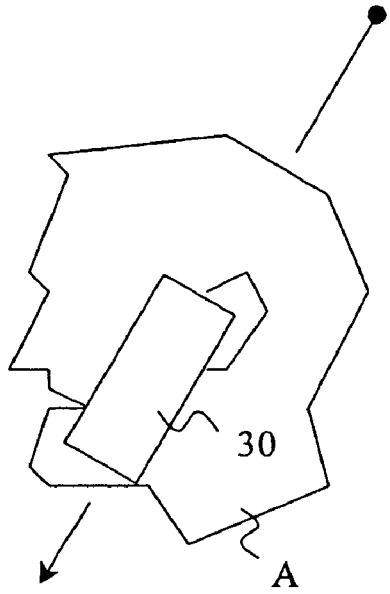
Figure 5C:
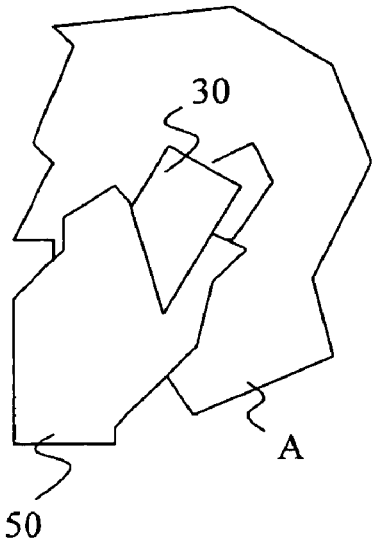

As can be seen from FIG. 4, a vertical arrow illustrates the position of the antenna 12 in relation to the ground plane 20, where the apex of the arrow indicates the end of the antenna device 1 at which the antenna 12 is located. FIGS. 5A and 5B illustrate exemplary talking positions of a mobile phone 30 when operated by a user A. In FIG. 5A, the mobile phone is designed in the common way with the antenna 112 at the top of the phone 30, i.e. closest to the listening end of the phone 30 carrying the loudspeaker 32. In FIG. 5B, the mobile phone is designed with the antenna device 1 in the opposite way, with the antenna 12 at the bottom of the phone 30, closest to the speaking end of the phone 30 carrying the microphone 31. FIG. 5C illustrates schematically the mobile phone 30 in operation by the user A, where the user A holds the phone 30 in his hand 50. If the antenna 12 is oriented in the way indicated in FIG. 5B, the hand 50 will effect the performance of the antenna 12, whereas for a design according to FIG. 5A the effect influence of the hand will probably be less noticeable.

Figure 6A:
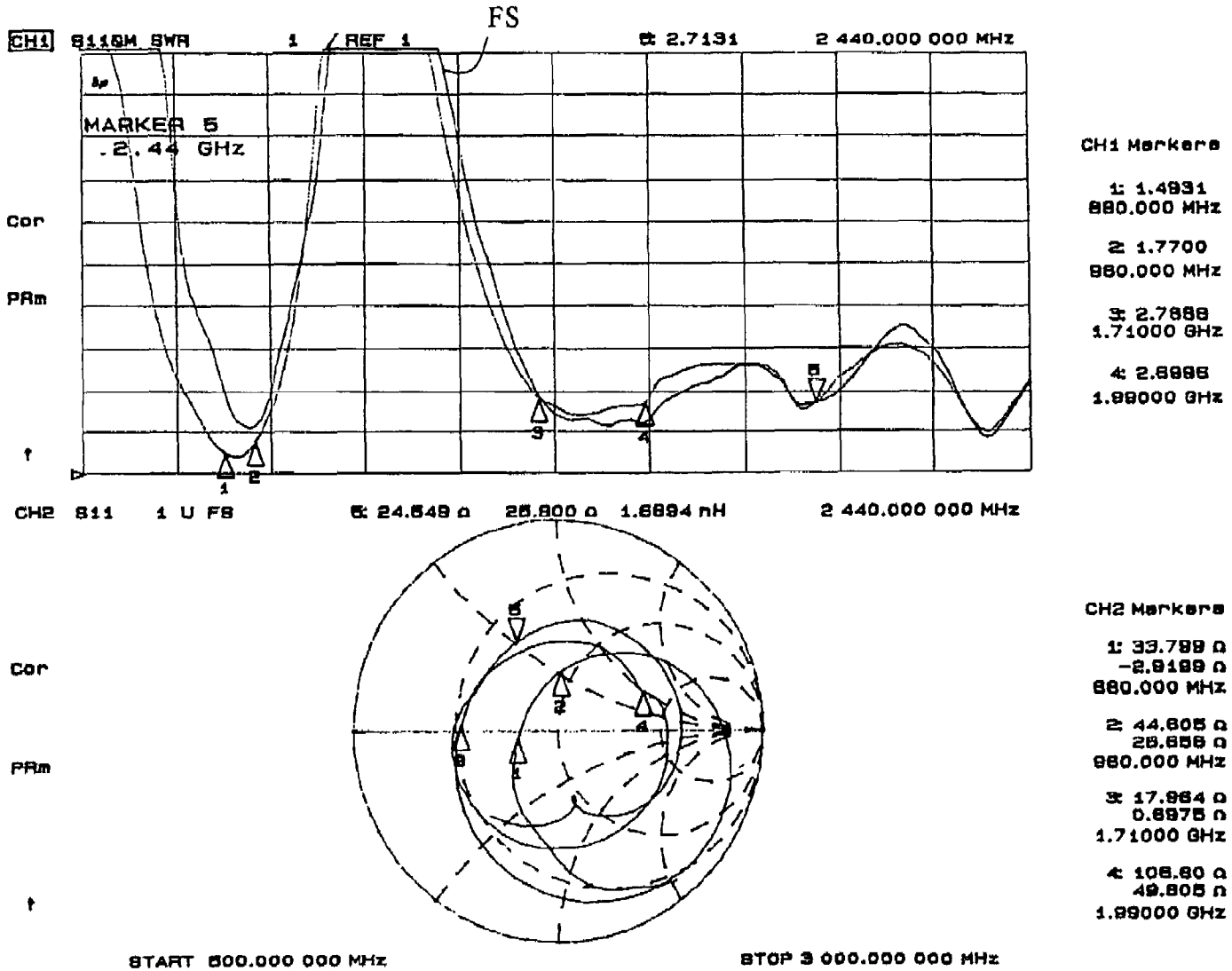
FIG. 6A illustrates the voltage standing wave ratio (VSWR) characteristics for the antenna design of the present invention in operation oriented according to FIG. 5A.
Figure 6B:
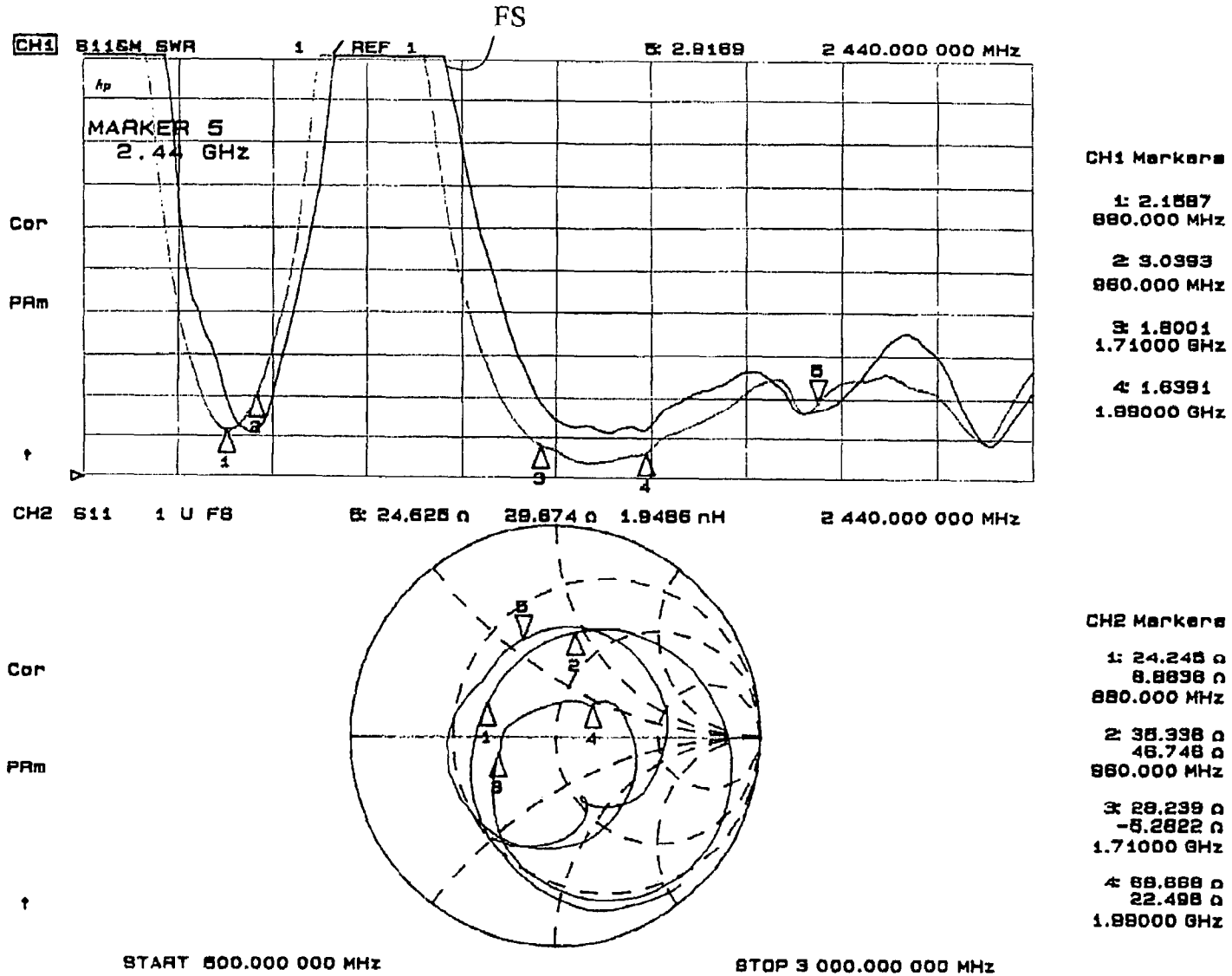
FIG. 6B illustrates the VSWR characteristics for the antenna design of the present invention in operation oriented according to FIG. 5B.

FIGS. 6A and 6B illustrates the VSWR performance of the presented antenna design, in an embodiment as described in conjunction with FIGS. 1 and 2, with a ground plane of 11 cm, i.e. a third of the wavelength of the lowest resonance frequency 900 MHz. The results come from a hand-made prototype, with the aid of the IE3D tool mentioned above. Markers point towards one of the curves in each drawing, and the frequency at each of those markers is illustrated in the respective drawing.

FIG. 6A relates to measurements with a top-mounted antenna 12. The black line indicates the VSWR measured when the mobile phone 30 is placed in free space FS. The grey line, to which the triangular markers 1 to 5 point, represents talking position TP, as illustrated in FIG. 5C, with the orientation of the phone 30 as illustrated in FIG. 5A. Since the antenna is located in the upper part of the phone 30, the antenna 12 is ideally not covered by the hand. A slight difference can be detected between the curves, due to the proximity of the hand and head rendering an enlarged ground plane to the antenna 12.

Contrary to the preceding figure, FIG. 6B relates to measurements with a bottom-mounted antenna 12, i.e. the phone is in operative position oriented as shown in FIG. 5B. Once again, the black line indicates the VSWR measured when the mobile phone 30 is placed in free space FS, i.e. with no human tissue close to the antenna. The grey line, to which the triangular markers 1 to 5 point, represents talking position TP, as illustrated in FIG. 5C, with the orientation of the phone 30 as illustrated in FIG. 5B. The antenna is now partly or fully covered by the hand. The effect is considerably larger than in the case displayed in FIG. 6A, with a much more significant difference between FS and TP. In VSWR point this is to the better.

The results of the VSWR measurements show excellent results for both the antenna orientation according to FIG. 5A and the antenna orientation according to FIG. 5B. It is noticeable that the hand influences the matching positively. It loads the antenna and steals some energy, but the head is further away from the antenna so the efficiency is probably better.

Consequently, one way to get a really low SAR (Specific Absorption Rate) value is to have the antenna near the mouth rather than the ear, an "upside down concept", as in FIG. 5B. As mentioned before, a ground plane of length about 11 cm, equal to one third of the wavelength at 900 MHz, has been found to give the best results. Other lengths may also be used.

Tests have also been performed on the gain, and indicate a good performance compared to the designs available today. Those experiments were also made with additional ground planes parallel to the antenna structure 12, behind it. Distances between 5 mm and 10 mm were tested, with the ground planes either hanging freely or grounded to the PCB ground 20. The best result was achieved without any additional ground plane, i.e. with the antenna design proposed in this description, with the antenna upside down as in FIG. 5B. Exactly how much a hand influences the gain has not been tested, though, since it is very individual how to hold a mobile phone.

Several effects and advantages are obtained by the invention. As evidenced by the graphs of FIGS. 6A and 6B, a multi-band performance in frequency point of view is reached, suitable for e.g. AMPS, EGSM, DCSS, PCS, UMTS and BT. Furthermore, there is broad band performance on each band. The gain and efficiency is also good compared to the market products.

No ground plane is needed underneath the antenna 12, which is otherwise the common case for the built-in antennas existing on the market. The built-in antenna is fairly small and very thin. Furthermore, it is possible to manufacture antenna 12 and PCB 41, having a ground plane 20, in one piece 40, which is mechanically very robust. The antenna structure can be etched out from the PCB directly. No grounding of the antenna is needed, only the parasitic elements 5,6 need ground. The design also has capabilities of rendering a low cost manufacture process, since no antenna connector is needed, and in that the antenna device 1 may be formed from a single film of e.g. copper.

With the antenna device 1 arranged upside down, it is also possible to obtain very low SAR. It is however important that the user A realizes how to hold the mobile phone properly.

The proposed design does not have an antenna volume in an ordinary sense, since the height to the ground plane is zero. A very thin mobile phone 30 can therefore be built. The antenna 12 area is approximately 41*20 mm, and is preferably etched on the PCB. The antenna 12 comprises two parasitic elements 5,6 which are parallel with the main antenna structure 2, and with each other. They are not meandered and do not have any capacitive end load.

The foregoing has described the principles, preferred embodiments and modes of operation of the present invention. However, the invention should not be construed as being limited to the particular embodiments discussed above. For example, while the antenna of the present invention has been discussed primarily as being a radiator, one skilled in the art will appreciate that the antenna of the present invention would also be used as a sensor for receiving information at specific frequencies. Similarly, the dimensions of the various elements may vary based on the specific application. Thus, the above-described embodiments should be regarded as illustrative rather than restrictive, and it should be appreciated that variations may be made in those embodiments by workers skilled in the art without departing from the scope of the present invention as defined by the following claims.

The invention claimed is:

1. A multi-band radio antenna device for a radio communication terminal comprising:

a flat ground substrate;

a flat main radiating element having a radio signal feeding point; and a flat parasitic element; and wherein the flat main radiating element is located in the same plane as the flat ground substrate; and wherein a first elongated portion of the flat main radiating element extends in an L shape away from a side edge of the flat ground substrate, a longer leg of the L shape extending substantially parallel to the side edge.

2. The multi-band radio antenna device of claim 1, wherein the first elongated portion has a first width, and extends into a second elongated portion having a second width, the second width being smaller than the first width.

3. The multi-band radio antenna device of claim 2, wherein a length of the first elongated portion corresponds to a resonance of a first radio wavelength and a combined length of the first elongated portion and the second elongated portion corresponds to a resonance of a second radio wavelength.

4. The multi-band radio antenna device of claim 2, wherein the second elongated portion is meandered.

5. The multi-band radio antenna device of claim 2, wherein the first width is at least 5 times larger than the second width.

6. The multi-band radio antenna device of claim 2, wherein the first width is at least 10 times larger than the second width.

7. The multi-band radio antenna device of claim 1, wherein the flat parasitic element comprises a first L-shaped parasitic member extending from an electrical connection point to the flat ground substrate essentially parallel to the first elongated portion of the flat main radiating element.

8. The multi-band radio antenna device of claim 7, wherein the flat parasitic element further comprises a second L-shaped parasitic member extending from an electrical connection point to the flat ground substrate essentially parallel to the first L-shaped parasitic member.

9. The multi-band radio antenna device of claim 1, wherein the flat main radiating element is dielectrically separated from the flat ground substrate.

10. The multi-band radio antenna device of claim 1, wherein a length of the flat ground substrate is approximately one third of a wavelength of a radio frequency band for which the multi-band radio antenna device is tuned.

11. A communication terminal devised for multi-band radio communication comprising;

a housing;

a user input and output interface; and a built-in antenna device in the housing, the built-in antenna device including:

a flat ground substrate;

a flat main radiating element having a radio signal feeding point; and a flat parasitic element; and wherein the flat main radiating element is located in the same plane as the flat ground substrate; and wherein a first elongated portion of the flat main radiating element extends in an L shape away from a side edge of the flat ground substrate, a longer leg of the L shape extending substantially parallel to the side edge.

12. The communication terminal of claim 11, wherein the first elongated portion has a first width, and extends into a second elongated portion having a second width, the second width being smaller than the first width.

13. The communication terminal of claim 12, wherein a length of the first elongated portion corresponds to a resonance of a first radio wavelength and a combined length of the first elongated portion and the second elongated portion corresponds to a resonance of a second radio wavelength.

14. The communication terminal of claim 12, wherein the second elongated portion is meandered.

15. The communication terminal of claim 12, wherein the first width is at least 5 times larger than the second width.

16. The communication terminal of claim 12, wherein the first width is at least 10 times larger than the second width.

17. The communication terminal of claim 11, wherein the flat parasitic element comprises a first L-shaped parasitic member extending from an electrical connection point to the flat ground substrate essentially parallel to said first elongated portion of the flat main radiating element.

18. The communication terminal of claim 17, wherein the flat parasitic element further comprises a second L-shaped parasitic member extending from an electrical connection point to the flat ground substrate essentially parallel to the first L-shaped parasitic member.

19. The communication terminal of claim 11, wherein the flat main radiating element is dielectrically separated from the flat ground substrate.

20. The communication terminal of claim 11, wherein a length of the flat ground substrate is approximately one third of a wavelength of a radio frequency band for which the built-in antenna device is tuned.

21. A multi-band radio antenna for a radio communication terminal comprising:

a flat main radiating element having a radio signal feeding point; and a flat parasitic element; and wherein the multi-band radio antenna is connectable to a flat ground substrate by interconnection with the flat parasitic element such that the flat main radiating element is located in the same plane as the flat ground substrate; and wherein a first elongated portion of the flat main radiating element extends in an L shape away from a side edge of the flat ground substrate, a longer leg of the L shape extending substantially parallel to the side edge.

22. An integrated multi-band radio antenna and ground substrate device for a radio communication terminal; comprising a flat ground substrate;

a flat main radiating element having a radio signal feeding point; and a flat parasitic element; and wherein the flat main radiating element is located in substantially the same plane as the flat ground substrate; and wherein a first elongated portion of the flat main radiating element extends in an L shape away from a side edge of the flat ground substrate, a longer leg of the L shape extending substantially parallel to the side edge.

23. The integrated multi-band radio antenna and ground substrate device of claim 22, wherein the flat ground substrate, the flat main radiating element and the flat parasitic element are formed of a single sheet of electrically conductive material.

24. The integrated multi-band radio antenna and ground substrate device of claim 22, wherein the flat ground substrate, the flat main radiating element and the flat parasitic element are etched out from a metal layer on a printed circuit board.

25. The integrated multi-band radio antenna and ground substrate device of claim 22, wherein the flat ground substrate is formed on one layer of a printed circuit board, and the flat main radiating element and the flat parasitic element are formed on another layer on the printed circuit board.

26. The integrated multi-band radio antenna and ground substrate device of claim 22, wherein the first elongated portion has a first width, and extends into a second elongated portion having a second width, the second width being smaller than the first width.

27. The integrated multi-band radio antenna and ground substrate device of claim 26, wherein a length of the first elongated portion corresponds to a resonance of a first radio wavelength and a combined length of the first elongated portion and the second elongated portion corresponds to a resonance of a second radio wavelength.

28. The integrated multi-band radio antenna and ground substrate device of claim 26, wherein the second elongated portion is meandered.

29. The integrated multi-band radio antenna and ground substrate device of claim 26, wherein the first width is at least 5 times larger than the second width.

30. The integrated multi-band radio antenna and ground substrate device of claim 26, wherein the first width is at least 10 times larger than the second width.

31. The integrated multi-band radio antenna and ground substrate device of claim 22, wherein the flat parasitic element comprises a first L-shaped parasitic member extending from an electrical connection point to the flat ground substrate essentially parallel to the first elongated portion of the flat main radiating element.

32. The integrated multi-band radio antenna and ground substrate device of claim 31, wherein the flat parasitic element further comprises a second L-shaped parasitic member extending from an electrical connection point to the flat ground substrate essentially parallel to the first L-shaped parasitic member.

33. The integrated multi-band radio antenna and ground substrate device of claim 22, wherein the flat main radiating element is dielectrically separated from the flat ground substrate.

* * * * *